US006688990B2

(12) United States Patent
Sanchez

(10) Patent No.: US 6,688,990 B2
(45) Date of Patent: Feb. 10, 2004

(54) GOLF PUTTER

(75) Inventor: Robert P. Sanchez, Chicago, IL (US)

(73) Assignee: Robsan Corporation, Chicago, IL (US)

( * ) Notice: Subject to any disclaimer, the term of this patent is extended or adjusted under 35 U.S.C. 154(b) by 0 days.

(21) Appl. No.: 10/138,847

(22) Filed: May 3, 2002

(65) Prior Publication Data

US 2003/0207725 A1 Nov. 6, 2003

(51) Int. Cl.[7] ..... A63B 53/04
(52) U.S. Cl. ..... 473/340; 473/290; 473/313
(58) Field of Search ..... 473/313, 314, 473/290, 334, 337, 349, 340

(56) References Cited

U.S. PATENT DOCUMENTS

| | | | | | |
|---|---|---|---|---|---|
| 1,659,231 | A | | 2/1928 | Baack | |
| D179,002 | S | | 10/1956 | Hoffmeister | D34/5 |
| D197,238 | S | | 12/1963 | Lilly | D34/5 |
| 3,260,525 | A | | 7/1966 | Ortel | 273/77 |
| 3,387,845 | A | | 6/1968 | Raub | 273/77 |
| 3,771,788 | A | | 11/1973 | Hurley et al. | 273/68 |
| D233,616 | S | | 11/1974 | Verzillo | D34/5 GH |
| 3,908,996 | A | | 9/1975 | Molinaro | 273/83 |
| 3,917,277 | A | | 11/1975 | Beck et al. | 273/163 R |
| D238,499 | S | | 1/1976 | Prochnow | D34/5 GH |
| D248,050 | S | | 5/1978 | Muehl | D34/5 GH |
| 4,138,117 | A | | 2/1979 | Dalton | 273/164 |
| 4,314,701 | A | | 2/1982 | Swanson | 273/164 |
| 4,324,404 | A | | 4/1982 | Dian | 273/169 |
| D269,537 | S | | 6/1983 | Tucker | D21/219 |
| 4,592,552 | A | | 6/1986 | Garber | 273/168 |
| D285,473 | S | | 9/1986 | Flood | D21/214 |
| D311,049 | S | | 10/1990 | Sanchez | D21/219 |
| D314,030 | S | | 1/1991 | Sanchez | D21/217 |
| 5,046,740 | A | * | 9/1991 | D'Eath | 473/255 |
| 5,320,353 | A | | 6/1994 | Moore | 273/167 F |
| 5,344,149 | A | | 9/1994 | Miller | 273/167 B |
| 5,344,151 | A | * | 9/1994 | Anderson et al. | 473/337 |
| 5,501,461 | A | | 3/1996 | Donofrio | 273/171 |
| 5,630,765 | A | | 5/1997 | Moore | 473/252 |
| 5,688,189 | A | | 11/1997 | Bland | 473/314 |
| 5,916,035 | A | | 6/1999 | Caiozzo | 473/252 |

OTHER PUBLICATIONS

Robsan pamphlet/brochure *"Control Center® Putter"* published Apr. 23, 1997.

Machine Shop Drawings of Robsan Golf Co. Control Center Putter, U.S. Pat. No. D 314,030, published Apr. 4, 1997.

Advertisement: *"Discover the Wonders of the Pyramid Putter!"* of Pyramid Putter, published at least as early Mar. 2000.

Publication: *"Q" To Suceess—Western Springs Man Patents Golf Implement* by Wendy Foster, published by *The Suburban Life Citizen*, Aug. 26, 1998, Section Two, p. 1.

Advertisement: *"T–Roll® Golf Putter and Chipper"* by T–Roll®Putter Technology, published at least as early as Feb. 7, 2001.

Advertisement: *"Millennium Golf M2 Putter"* by Millennium Golf M2 Putter, published at least as early as Feb. 6, 2001.

Brochure (Marketing Material): *"Prestige Pool Putter"* of Prestige, distributed by Coco Island Golf &Sport of Medley, Florida, published at least as early as Jan. 2000.

Publication: *"American Evolution"* by Golf Magazines, published Mar. 1988, p. 112.

Publication: *"What's in my bag?"* by Tom Watson, published in *Equipment Digest*, published at least as early as Jun. 2001, pp. 249–151.

* cited by examiner

*Primary Examiner*—Paul T. Sewell
*Assistant Examiner*—Tom P Duong
(74) *Attorney, Agent, or Firm*—Welsh & Katz, Ltd.; Thomas W. Tolpin

(57) ABSTRACT

An attractive user-friendly golf putter is provided with a special center weighted housing and side weights to enhance the accuracy, ease and reliability of putting. The side weights are preferably positioned between the center weighted housing and the toe and heel of the golf putter.

19 Claims, 2 Drawing Sheets

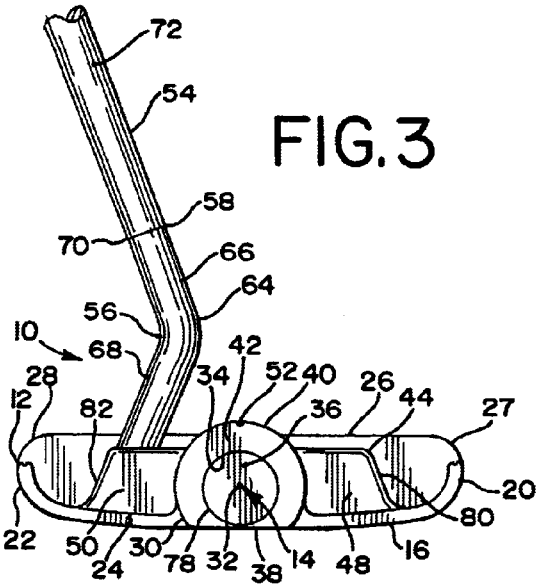
FIG.3
FIG.4
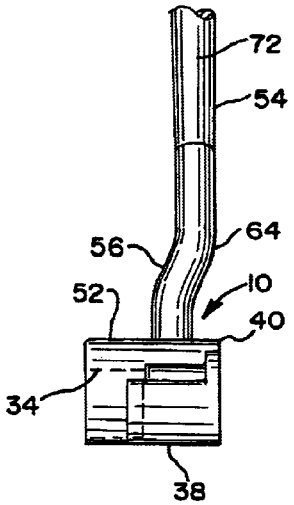
FIG.5
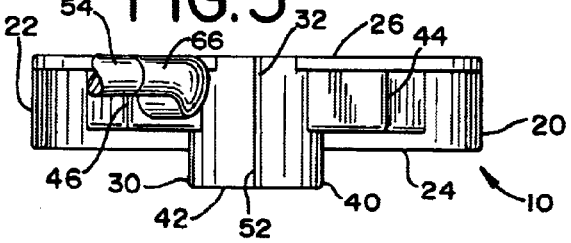
FIG.6
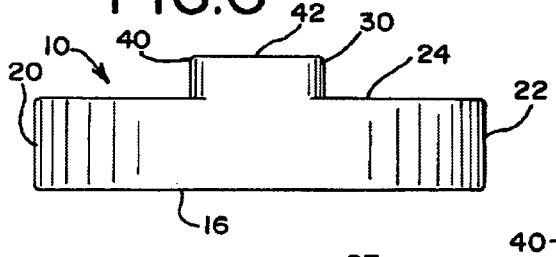
FIG.7
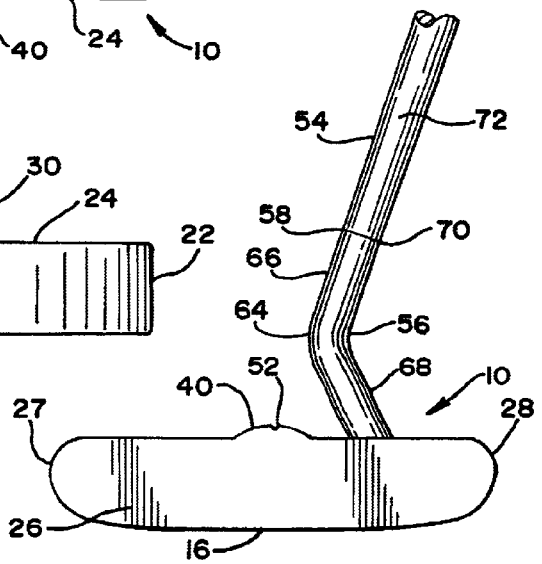

GOLF PUTTER

BACKGROUND OF THE INVENTION

This invention relates to golf and, more particularly to golf putters.

Over the years various golf putters (putting clubs) have been developed. These prior golf putters have met with varying degrees of success. Many of these prior golf putters, however, are awkward, cumbersome, difficult to use, off balance, inconvenient, inaccurate, undependable, uncomfortable, burdensome, unattractive, costly, ineffective, create loft, cause underspin (backspin), don't align squarely with a golf ball, twist in a golfer's hands, and/or have other deficiencies. It is, therefore, desirable to provide an improved golf putter which overcomes most, if not all, of the preceding problems.

Excellent golf putters have been developed by applicant as shown in U.S. Design Pat. Nos. Des. 311,049 and 314,090. There is, however, a desire to provide more improved golf putters which further enhance the ease and accuracy of putting.

BRIEF SUMMARY OF THE INVENTION

An improved golf putter (putting club) is provided which enhances the ease and accuracy of putting. The superb golf putter is comfortable, easy to use, reliable, and efficient. Advantageously, the user-friendly golf putter is attractive, economical, and fun. Furthermore, the superior golf putter is well balanced, aligns squarely with a golf ball, minimizes loft and under spin (backspin) of the golf ball and twisting of the club. Desirably, the improved golf putter has achieved unexpected, surprisingly good results.

To this end, in one form the inventive golf putter has a front strike face for putting a golf ball, a center weighted housing which extends rearwardly from the front face and contains one or more center weights, and substantially upright offset symmetrical side weighted portions (lateral weighted portions) which extend sideways (laterally) from the center weighted housing. The side weighted portions contain side weights which are positioned in offset relationship to the center weights. Advantageously, the combined weight of the center weighted housing and the center weights are at least 3.5 times greater than the total weight of the side weights in order to enhance the golfer's putting stroke, as well as the accuracy, consistency and comfort of putting a golf ball. Desirably, the ratio of the total combined weight of the center weighted housing and the center weights to the total weight of the side weight ranges from about 4.5:1 to about 5:1. The weight of the center weighted housing can be at least twice the total weight about the side weights. Preferably, the center weights total more than twice the total weight of the side weights. In the preferred form, the center weights comprises 8 to 10 center weights; the center weights weigh a total of about 2 to about 2.5 times more than the total weight of said side weights; and the center weighted housing weigh about 2 to about 2.5 times more than the total weight of the side weights.

In another form, the golf putter comprises a head which defines a center and has a bottom with a substantially planar or flat bottom surface positioned below the center. The head can have a rounded toe and rounded heel which extend upwardly from the bottom surface on longitudinally opposite sides of the center. A back edge can extend longitudinally between and connect the toe and heel. A front face is positioned forwardly of the back edge and can extend upwardly to a height above the toe and heel for putting a golf ball. The bottom of the head can extend transversely between and connect the front face and back edge.

In a preferred from, the center weighted housing of the golf putter has a substantially upright back wall providing an upright back surface which is positioned substantially perpendicular and at right angles to the outer surface of the center weighted housing without any tampering or chamfering. In this form, the upright back wall and back surface of the center weighted housing do not have a tapered or chamfered portion(s). Desirably, the back surface of the back of the center weighted housing is in substantial parallel relationship with the front face of the golf putter. The side weighted portions of the golf putter can have substantially upright rearward walls which are positioned substantially parallel to the back surface of the center weighted housing. In order to provide better performance, the side-weighted portions are spaced from the toe and heel of the golf putter.

The apex or peak of the outer surface of the center weighted housing can be grooved and/or define a primary sight line to align the golf ball and front face of the putter with the hole (cup) on the green. Desirably, the primary sight line extends entirely transversely across the outer and upper surface of the center weighted housing to the back surface (back wall) of the center weighted housing.

In the preferred form, the golf putter has a shaft, which is positioned in substantial alignment with the center of the head of the golf putter. A connecter (hosel) can be provided to connect the shaft to one of the side weighted portions of the golf putter.

A more detailed explanation of the invention is provided in the following description and appended claims taken in conjunction with the accompanying drawings.

BRIEF DESCRIPTION OF THE DRAWINGS

FIG. 3 is a back view of the head and other portions of the golf putter;

FIG. 4 is a side view of the head and other portions of the golf putter;

FIG. 5 is a top view of the head and other portions of the golf putter;

FIG. 6 is a bottom view of the head and other portions of the golf putter; and FIG. 7 is a front view of the head and other portions of the golf putter.

DETAILED DESCRIPTION OF THE INVENTION

A golf putter 10 (FIGS. 1–7) according to the preferred embodiment of the present invention will now be explained.

Figure 2:
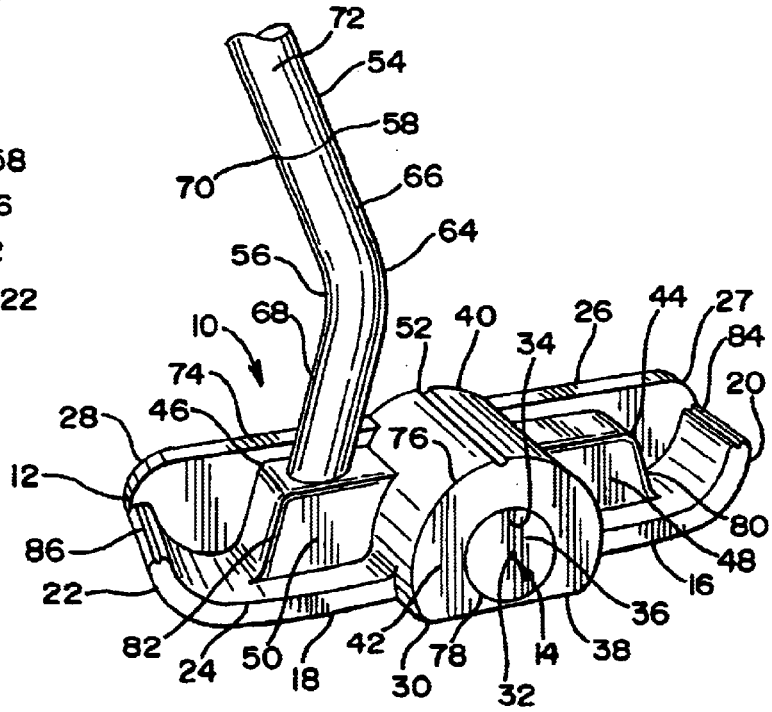
FIG. 2 is an enlarged perspective view of the head and other portions of the golf putter.

The user-friendly golf putter has a head 12 (FIGS. 2–3), which defines a center 14. The head has a bottom 16 with a flat or substantially planar bottom surface 18, which is positioned, below the center of the head. The head also has a rounded toe 20 and rounded heel 22 which extend upwardly from the bottom surface of the head. The toe and heel are spaced longitudinally apart from each other on opposite sides of the center of the head. The head also has a back edge 24 (FIGS. 2–3), which extends longitudinally between and connects the toe and heel of the head. The back edge of the head also extends upwardly and vertically from the bottom surface of the head. The head of the golf putter also has a flat or substantially planar from strike face 26 with rounded corners 27–28 (FIGS. 2, 3 and 7). The front face extends upwardly and vertically from the bottom surface of the head to a height above the toe and heel. The front face is also positioned forwardly of the back edge of the head and provides a striking surface to strike, engage, and putt the golf ball. The front face can have a zero degree loft so that the front face can be positioned squarely to the golf ball to minimize loft and back spin (under spin) of the golf ball when putting, as desired. The front face can also have a thickness of about 1/16 inch. The bottom of the head extends transversely between and connects the front face and the back edge of the head.

A center weighted housing 30 (FIGS. 2, 3, 5 and 6) provide a center weighted portion about the center of the head. The center weighted portion can define a transverse horizontal axis 32, which extends transversely and horizontally through the center of the head. Desirably, the center weighted portion defines a recessed opening 314 that provides a center weight-receiving cavity to receive one or more center weights 36. The center weighted housing can extend integrally upwardly from the bottom of the head and transversely connects the front face of the head to the back edge of the head. Desirably, the center weighted housing extends rearwardly of the back edge of the housing and has a flat or substantially planar bottom section 38 which is preferably positioned in coplanar relationship with the bottom surface of the head. The center weighted housing can have an outer surface 40 which extends above the front face of the head. Preferably, the center weighted housing has an upright vertical back surface (back wall) 42 which is positioned at right angles and substantially perpendicular to the outer surface of the center weighted housing without any tapering or chamfering.

The golf putter has substantially upright vertical symmetrical side weighted portions (laterally weighted portions) 44 and 46 (FIGS. 2, 3 and 5), which extend longitudinally from the center weighted housing on opposite sides of the center. The side-weighted portions can also extend integrally upwardly from the bottom of the head. In the preferred embodiment, the side-weighted portions are spaced inwardly from the back edge of the head, as well as spaced inwardly from the upright back surface (back wall) of the center weighted housing. The center weighted portions are spaced from the toe and heel of the head and contain side weights 48 and 50. The side weights are positioned in offset relationship to the center weights and cooperate with the center weights to enhance putting of the golf ball and performance of the golf putter. The center weights can be integrally connected to the walls of the side weights portions.

The outer surface of the center weighted housing can define a primary sight line 52 comprising a groove which extends entirely transversely across the outer surface to the back surface to align the golf ball with a hole (cup) on a green. The sight line can be substantially parallel to the transverse horizontal axis 32.

Figure 1:
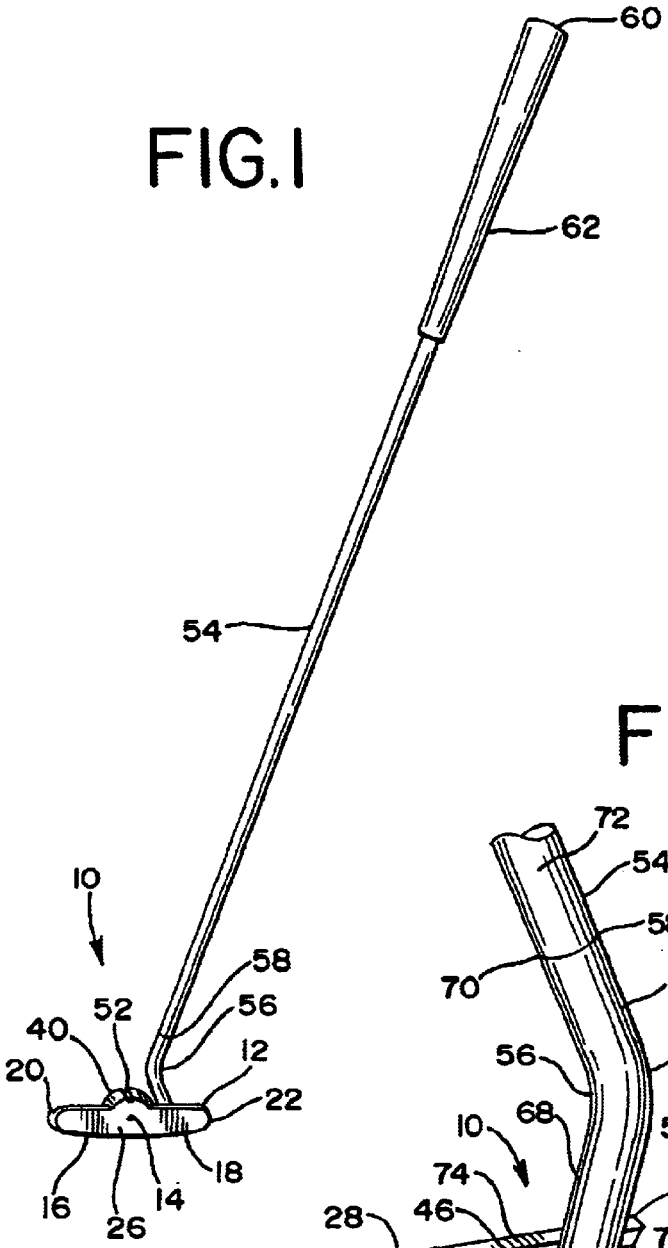
FIG. 1 is a perspective view of the golf putter in accordance with principles of the present invention.

As best shown in FIG. 1, the golf putter has an elongated shaft 54 which is positioned in substantial alignment with the center of the head. The golf putter preferably has a hosel 56 which provides a connector or shaft-connecting section to receive the attached end 58 of the shaft. The shaft also has an unattached cantilevered end 60 with a manually grippable hand 62 thereon. The shaft can define an elongated axis 72 (FIGS. 3, 4, and 7).

As previously indicated, the golf putter can also have a hosel 56 (FIGS. 2 and 3) which comprises a shaft-connecting section. The shaft-connecting section provides a shaft connector. In the illustrative embodiment, the shaft connector comprises a convex bent neck 64 with an upper tubular shaft-receiving portion 66 and a lower head-engaging portion 68. The upper tubular shaft-receiving portion can define a shaft-receiving socket 70 to telescopically receive and securely engage the attached end of the shaft. The upper tubular shaft-receiving portion of the hosel can define an axis positioned in substantial alignment with the elongated axis 72 of the shaft. The lower head engaging portion of the hosel can be positioned at an angle of inclination to the elongated axis of the shaft as well as at an obtuse angle of inclination to the upper tubular shaft-receiving portion of the hosel.

The shaft can be made of steel, although other metals and other material such as graphite, titanium, and fiberglass can be used if desired. The manual grippable handle provides a grip, which can be made of rubber or rubber-type plastic. The hosel can be made of stainless steel or other metal and is preferably modeled out of the same material and integral with the head of the putter. The head of the putter can be made of stainless steel, such as 17-4 stainless steel, e.g. 17 parts nickel and 24 parts chromium. Other materials can be used, if desired.

As previously discussed, the head of the golf putter has a center and front strike face to engage and putt a golf ball. The front face of the putter has a top surface 74 (FIG. 2) providing a top edge and a bottom surface 18 providing a bottom. The rearward edge 24 of the head of golf putter provides a back edge, which is positioned rearwardly of the front face of the head of the putter. The toe 20 and heel 22 are spaced away from each and span a longitudinal distance to provide a longitudinal span. A longitudinal span is substantially greater than the minimum distance (width) between the front face and back edge of the head of the putter.

The center weighted housing 30 (FIG. 2) is preferably positioned concentrically about the center of the head of the golf putter. The center weighted housing comprises an annular tubular wall 76. The annular tubular wall provides a center weighted socket that defines a central weight-receiving opening 34 and cavity to receive a set of center weights 36. The tubular wall 34 has an annular inner surface 78, which is preferably positioned about and circumferentially surrounds the center weight-receiving opening of the center weighted housing. The center weighted housing can have an outer arcuate surface 40 which extends obliquely about the center of the head of the putter at an arc greater than 180 degrees and less than 360 degrees. Desirably, the outer surface extends above the top face of the head of the putter and provides a peak or apex, which defines a primary sight line 52. The primary sight line can be grooved, undercut, recessed and/or painted such as with a waterproof paint. The primary sight line is positioned above and aligned in registration with the center of the head of the golf putter. The outer surface of the center weighted portion can be positioned near in close proximity with and adjacent the annular inner surface of the center weighted portion adjacent the bottom of the head of the golf putter. The center weighted housing 30 (FIGS. 2 and 3) can have a flat or substantially planar bottom section 38 which can be positioned in coplanar relationship with the bottom 16 of the head of the golf putter. In the illustrative embodiment, the tubular wall 76 of the center weighted housing has a greater thickness vertically above the center of the center weighted housing and head of the golf putter, than vertically below the center of the center weighted housing and head of the golf putter.

As previously explained, the center weighted housing preferably has a upright vertical arcuate back wall 42 (FIG. 2) which provides a back surface that is positioned at right angles and substantially perpendicular to the outer surface of the center weighted housing. The arcuate back wall 42 is positioned rearwardly of the back of the head of the golf putter. Desirably, the center weighted housing extends from the front face of the golf putter to a positioned rearwardly of the back edge of the head of the golf putter.

Preferably, the golf putter has a set of substantially symmetrical diametrically opposed laterally weighted side portions (side weighted portions) 44 and 46 (FIGS. 2 and 5). The laterally weighted side portions can provide upright vertical rigid stabilizing wings or fins which are connected to and extend longitudinally outwardly from the outer surface of the center weighted housing. As previously explained, the laterally weighted side portions contain lateral side weights 48 and 50 which are positioned laterally and in offset relationship with the transverse horizontal axis of the center weighted housing, the center of the head, and the center weights.

The laterally side portions preferably extend upwardly and vertically from the bottom of the head to a positioned spaced below the top of the front face of the golf putter and the apex 52 (FIG. 2) of the center weighted portion. The laterally side portions can comprise a toe-facing wing (fin) 44 and a heel-wing (fin) 46. The toe-facing wing can extend laterally from the center weighted housing toward the toe. The heel-facing wing can extend from a diametrically opposite portion of the center weighted housing toward the heel. Desirably, the wings are spaced from the toe and heel. The laterally weighted side portions are spaced inwardly of the back edge of the head of the golf putter, as well as spaced inwardly from the upright vertical back wall (back surface) of the center weighted housing. The laterally weighted portions can have upright vertical rearward (back) walls 48 and 50 which are preferably positioned substantially parallel to the upright back wall 42 of the center weighted housing as well as substantially parallel to the front face of the golf putter. In the illustrative embodiment, the heel-facing wing is securely connected to the lower-head-engaging portion of the hosel (shaft-connecting section) at a location between the center weighted housing and the heel of the golf putter.

Advantageously, the elongated axis of the shaft is substantially aligned with the center of the head of the golf putter for face balance of the golf putter. Each of the side weights 48 and 50 (FIGS. 2 and 3) can be about 6 grams each. Most preferably, each laterally weighted portion contains only one 6-gram side weight. Desirably, the golf putter has a pair of laterally weighted side portions with outwardly extending sloping sidewalls 80 and 82.

In the preferred embodiment, the center weighted housing contains a set of weighted discs comprising dime-size center weights 36 (FIGS. 2 and 3). Each dime size center weight can weight about 3 grams. The dime-size center weights can comprise 1–10 center weights. Most preferably, the set of dime-size center weights comprises at least 8 dime-size center weights weighing a total of about 21 grams to about 30 grams. The tubular wall 76 (FIG. 2) of the center weighted housing can weight about 24 grams. The back wall (back surface) 42 of the center weighted housing can have upper rounded corners. The central weight-receiving opening 34 of the center weighted housing can define a substantially horizontal bore which extends transversely for about ¾ inch from the back wall (back surface) 42 of the center weighted housing to the front face 26 of the golf putter.

In the illustrative embodiment, the toe and heel define transverse sight lines 84 and 86 (FIG. 2), which are preferably positioned in substantial parallel relationship to each other and the primary sight line 52. As previously explained, preferably, the primary sight line 52 extends entirely from the front face to the back wall of the center weighted housing.

In the illustrative embodiment, the ratio of the center weights 36 (FIG. 2) to each of the side weights 48 or 50 ranges from about 4:1 to about 5:1.

In accordance with principles of the present invention, a set of golf putters 10 can be provided having a similar size and appearance. Each of the golf putters can have a different amount of center weights so that the total weight of the center weights of each of the golf putters are different.

The total weight of the center weights of the center weighted housing can be adjusted by increasing or decreasing the amount (number) of dime-size center weights. In some circumstances, it may be desirable to use other size weights.

The hosel (shaft-connecting section) with its bent neck desirably provides an unobstructed view of the golf ball. The face of the golf club preferably has a zero degree loft to minimize backward rotation and backspin of the golf ball. The lateral sight lines assist in enhancing the golf's back swing as well as enhance peripheral vision in putting. The lateral sight lines also help keep the golf's swing straight.

The shaft is aligned with the center of the golf head for face balancing. The face balancing coupled with the center weighted housing and lateral side weights provide better performance and help obtain a pendulum-like swing. The face of the putter can lay square to the golf ball since the clubface has a zero degree loft and is not open or closed.

The center weighted housing of the golf putter can have different amount of weight to provide different weighted heads to fit the needs and body types of many types of golfers. Desirably, the cosmetic, external appearance, shape and look of golf putters can be similar while the internal center weights of the center weighted housing are different to provide a set, series and array of different weighted golf putters.

The primary sight line providing a center top sight line can be aligned with the center of the golf ball. The lateral sight lines providing the heel and toe sight lines can be used for aiming the golf ball at the hole (cup) on the green. The club head is preferably, the same span as the diameter of the hole (cup) so it is like aiming the club head to the hole. The back wall (back surface) of the center weighted housing can have a logo imprinted thereon to provide a rearward (back) sight line for visual reference to the back stroke of the golf swing. The shorter the putt, the shorter the backstroke can be.

Because of the unique weight distribution of the center weighted housing and side weighed portion of the golf putter, twisting of the golf head is eliminated or minimized. Off-center hits of the golf ball from the front face of the golf putter will still travel to the target hole (cup) on the green when the striking of the golf ball is within the center weighted area of the front face of the golf club.

Among the many advantages of the golf putter of the invention are:

1. A superior golf putter.
2. Greater ease and accuracy of putting.
3. Superb performance.
4. Center weighting in combination with side weights provide a larger and more forgiving sweetspot.
5. Minimizes twisting of the golf head upon impact of the golf ball.
6. Outstanding balance which helps provide a consistently straight-back-and-through stroke.
7. Face balancing gives the putter a pendulum-like feel.
8. Optional adjustable weights for custom putters.
9. Easily viewable sight lines to assist in precision aiming.
10. An enhanced primary center sight line that provides a visual aide in the alignment of the club head (sweetspot) in the center of golf ball.
11. Two horizontal side sight lines to assist in aiming the golf ball to the cup (hole).
12. Zero offset hosel for an unobstructed view of the golf ball.
13. A well-balanced club head and golf putter with a virtual perfect center of gravity.
14. A front face with a zero degrees loft to apply immediate topspin to the golf ball while minimizing backspin (under spin).
15. Easy to use.
16. Comfortable.
17. Dependable.
18. Efficient.
19. Economical.
20. Attractive.
21. Fun.
22. Effective.

Although embodiments of the invention have been shown and described, it is to be understood that various modifications, substitutions and rearrangements of parts, components, materials, and weights can be made by those skilled in the art without departing from the novel spirit and scope of this invention.

What is claimed is:

1. A golf putter, comprising:

a head defining a center and having a bottom with a substantially planar bottom surface positioned below said center, a rounded toe extending upwardly from said bottom surface, a rounded heel extending upwardly from said bottom surface and spaced longitudinally from said toe on an opposite side of said center, a back edge extending longitudinally between and connecting said toe and heel and extending upwardly from said bottom surface, a front face extending upwardly from said bottom surface to a height above said toe and heel for putting a golf ball, said front face extending rearwardly for a thickness less than 0.125 inches, said front face being positioned forwardly of said back edge, said back edge being positioned rearwardly of said front face, and said bottom extending transversely between and connecting said front face and said back edge;

a center weighted housing providing a center weighted portion about said center, said center weighted portion defining a transverse horizontal axis extending transversely through said center and defining a recessed opening providing a center weight-receiving cavity extending rearwardly for more than 0.550 inches for receiving one or more similar size center weights, said center weighted housing extending integrally upwardly from said bottom and transversely connecting said front face to said back edge, said center weighted housing extending rearwardly of said back edge and having a substantially planar bottom section positioned in coplanar relationship with said bottom surface, said center weighted housing having an outer surface extending above said front face and having a substantially upright back surface positioned rearwardly of said back edge, said back surface extending entirely across and connected to said outer surface to provide right angle corners, said back surface being substantially entirely parallel to said front face and being substantially perpendicular to said outer surface in the absence of a tapered or chamfered portion as viewed from above said head;

substantially upright symmetrical side weighted portions extending longitudinally from said center weighted housing on opposite sides of said center, said upright side weighted portions extending integrally upwardly from said bottom for a height, said side weighted portions providing a thickness extending rearwardly from said front face for a distance less than the height of said side weighted portion, said side weighted portions being entirely spaced forwardly of said back edge and said upright back surface of said center weighted housing, said side weighted portions being spaced from said toe and heel, said upright side weighted portions containing side weights positioned in offset relationship to said center weights and cooperating with said center weights for enhancing putting of the golf ball; and said front face defining a primary striking area aligned with said center weighted housing and secondary striking areas aligned with said side weighted portions.

2. A golf putter in accordance with claim 1 wherein:

said front face has a thickness of about 1/16 inch (0.063 inch);

said center weight-receiving cavity extends rearwardly for about ¾ inch (0.75 inch); and said outer surface of said center weighted housing defines a primary sight line extending entirely transversely across said outer surface to said back surface for aligning the golf ball with a hole on a green, and said sight line being substantially parallel to said transverse horizontal axis.

3. A golf putter in accordance with claim 1 wherein:

said side weighted portions each weigh about 6 grams and have substantially upright rearward walls positioned substantially parallel to said back surface of said center weighted housing;

said back surface of said center weighted housing being positioned in substantially parallel relationship with said font face;

said center weights total from about 21 grams to about 30 grams;

said gold putter has a shaft positioned in substantial alignment with said center; and said golf putter includes a connector (hosel) for connecting said shaft to one of said weighted portions.

4. A golf putter in accordance with claim 1 wherein the ratio of the total combined weight of said center weighted housing and said center weights to said total weight of said side weights ranges from about 4.5:1 to about 5:1.

5. A golf putter in accordance with claim 1 wherein the weight of said center weighted housing is at least twice the total weight of said side weights.

6. A golf putter in accordance with claim 1 wherein said center weights total more than twice the total weight of said side weights.

7. A golf putter in accordance with claim 1 wherein:

said center weights comprise 8 to 10 center weights;

said center weights weigh a total of about 2 to about 2.5 times more than the total weight of said side weights; and said center weighted housing weights about 2 to about 2.5 times more than the total weight of said side weights.

8. A golf putter, comprising:

an elongated shaft having an attached end and an unattached cantilevered end with a manually grippable handle thereon, said shaft defining an elongated axis;

a shaft-connecting section providing a shaft-connector comprising a convex bent neck portion, said upper tubular shaft-receiving portion defining a shaft-receiving socket for telescopically receiving and securely engaging the attached end of said shaft, said upper tubular shaft-receiving portion defining an axis in substantially alignment with the elongated axis of said shaft, said lower head-engaging portion positioned at an angle of inclination to the elongated axis of said shaft and at an obtuse angle of inclination to said upper tubular shaft-receiving portion;

a head defining a center and having a front strike face having a thickness less than 0.125 inches for engaging and putting a golf ball, said front face having a top surface providing a top surface providing a top and a bottom surface providing a bottom, a rearward edge providing a back edge positioned rearwardly of said front face, a toe positioned forwardly of the center, and a heel positioned rearwardly of the center, said toe being spaced and spanning a longitudinal distance from said heel to provide a longitudinal span therewith substantially greater than a minimum distance between said front face and back edge providing a width of said head;

said head comprising a center weighted housing providing a center weighted portion positioned substantially concentrically about the center of said head, said center weighted portion comprising an annular tubular wall providing a center weighted socket defining a central weight-receiving opening and cavity extending rearwardly for more than 0.550 inches for receiving a set of center weights, said tubular wall having an annular inner surface positioned about and circumferentially surrounding said central weight-receiving opening and having an outer arcuate surface extending obliquely about the center of said head at an arc greater than 180 degrees and less than 360 degrees, said outer surface extending above the top of said front face and providing a peak (apex) defining a primary sight line aligned in registration with the center of said head, said outer surface being positioned in close proximity with and adjacent the annular inner surface adjacent the bottom of said head, said center weighted portion having a substantially planar bottom section positioned in coplanar relationship with the bottom of said head, said tubular wall having a greater thickness vertically above the center having vertically below the center, said center weighted portion having an upright arcuate back wall positioned substantially perpendicular to said outer surface, said arcuate back wall being positioned rearwardly of the back of said head, said back wall extending entirely across and connected to said outer surface to provide right angle corners, said back surface being substantially entirely parallel to said front strike face, and said center weighted portion extending from said front face to a position rearwardly of said back edge of said head;

a set of substantially symmetrical diametrically opposed side weighted portions providing upright rigid secondary weights connected to the outer surface of said center weighted portion, said side weighted portions containing side weights positioned longitudinally and in offset relationship with the center and center weights, said side weighted portions extending upwardly for a height from the bottom of the head to a level spaced below the top of the front face and the apex of the center weighted portion, said side weighted portions having a thickness extending rearwardly from said front face for a distance less than the height of said side weighted portions, said side weighted portions providing said wings comprising a toe-facing wing and a heel-facing wing, said toe-facing secondary weights extending laterally from said center weighted portion toward said toe and said heel-facing secondary weight extending from said center weighted portion toward said heel, said secondary weights being spaced from said toe and heel, said side weighted portions being spaced inwardly of said back edge and said upright back wall of said center weighted housing, said side weighted portions having upright rearward walls positioned substantially parallel to said upward back wall of said center weighted housing and to said front lace, said heel-facing secondary weight being securely connected to said lower head-engaging portion of said shaft-connecting section at a location between said center weighted portion and said heel;

said front face defining a primary striking area aligned with said center weighted portion and secondary striking areas aligned with said side weighted portions; and the elongated axis of said shaft being substantially aligned with the center of said head for face balance of said golf putter.

9. A golf putter in accordance with claim 8 wherein each of said side weights are about 6 grams.

10. A golf putter in accordance with claim 8 wherein:

said side weighted portions consist of a pair of side weighted sections with outwardly extending sloping side walls; and each side weighted portion contains only one 6 gram side weight.

11. A golf putter in accordance with claim 8 wherein;

said center weighted portion contains a set of weighted discs comprising dime-size center weights, each dime-size center weight weighting about 3 grams;

said set of dime-size center weights comprises at least 8 dime-size center weights weighing a total of about 21 grams to about 30 grams.

12. A golf putter in accordance with claim 8 wherein said tubular wall of said center weighted portion providing said center weighted housing weights about 24 grams.

13. A golf putter in accordance with claim 8 wherein said central weight-receiving opening defines a substantially horizontal bore extending transversely for about ¾ inch deep from said back wall toward said front face.

14. A golf putter in accordance with claim 8 wherein said front face has a zero degree loft for positioning squarely to the golf ball to minimize loft and back spin of the golf ball when putting.

15. A golf putter in accordance with claim 8 wherein said front face has a thickness about 1/16 inch.

16. A golf putter in accordance with claim 8 wherein said toe and heel define transverse sight lines positioned in substantially parallel relationship to each other and to said primary sight line, and said primary sight line extends entirely from the front face to the back wall of said center weighted portion.

17. A golf putter in accordance with claim 8 wherein the ratio of said center weights to each of said side weights ranges from about 4:1 to about 5:1.

18. A golf putter in accordance with claim 8 including a set of golf putters having similar size and appearance, each of said golf putters having a different amount of center weights so that the total weight of the center weights of each of the golf putters are different.

19. A golf putter in accordance with claim 1 wherein the total weight of the center weights can be adjusted by increasing or decreasing the amount (number) of dime-size center weights.

* * * * *